US005211362A

United States Patent [19]

Householder

[11] Patent Number: 5,211,362

[45] Date of Patent: May 18, 1993

[54] ADJUSTABLE QUILTING HOOP STAND

[76] Inventor: Fred A. Householder, 14206 Hunter Hill, San Antonio, Tex. 78217

[21] Appl. No.: 851,084

[22] Filed: Mar. 13, 1992

[51] Int. Cl.[5] ..... A47G 29/00

[52] U.S. Cl. ..... 248/124; 223/120; 248/283

[58] Field of Search ..... 248/283, 282, 289.1, 248/276, 124, 121, 122

[56] References Cited

U.S. PATENT DOCUMENTS

| | | | |
|---|---|---|---|
| 4,546,708 | 10/1985 | Wilburth | 248/282 X |
| 4,548,373 | 10/1985 | Komura | 248/122 |
| 4,562,987 | 1/1986 | Leeds et al. | 248/283 X |
| 4,590,695 | 5/1986 | McGillivray | 248/278 X |
| 4,665,638 | 5/1987 | Morton | 248/172 X |
| 4,783,036 | 11/1988 | Vossollghi | 248/122 X |

*Primary Examiner*—Ramon O. Ramirez
*Attorney, Agent, or Firm*—Gunn, Lee & Miller

[57] ABSTRACT

A horizontal base-mounted device for adjustably locating a quilting hoop (18). The device comprises a vertical support column (12) with a base attached thereto, the base to anchor the vertical support column (12) to a horizontal base platform such as a desk, table, stand, or chair. A jointed arm (14) having a first arm member (32) and a second arm member (34) is attached to the vertical support column (12) such that it can rotate in a plane perpendicular to the vertical support column (12). The jointed arm (14) is adjustable so that it can be lengthened or shortened. At the removed end of the jointed arm (14) is attached a rotatable bar (44) adjustably mounted to the second arm member (34) of the jointed arm (14) with the axis of the rotatable bar (44) parallel to the second arm member (34) of the jointed arm (14). A quilting hoop support beam (52) is attached by an axle (54) through the center (53) thereof to the rotatable bar (44). A quilting hoop (18) is releasably attached to leg members (72) projecting perpendicularly from the removed ends of the quilting hoop support beam (52).

18 Claims, 2 Drawing Sheets

ADJUSTABLE QUILTING HOOP STAND

FIELD OF THE INVENTION

This invention relates to adjustable quilting hoop support stands, and more particularly, an adjustable quilting hoop support stand having an adjustable, extensible, jointed arm extending perpendicularly from a vertical support column, with the quilting hoop rotatably attached to the removed end of the extensible arm.

BACKGROUND

The present invention relates to frames for supporting fabric for needlework and the like, more particularly, to adjustable frames for holding the work piece in a preferred orientation.

In performing needlework activity, upon a sheet of fabric, the fabric is mounted in a hoop to provide a taut and planar surface through which to perform, needlework, such as quilting, embroidery and needlepoint. Both top and bottom surfaces of the fabric must be accessible to the user as the quilting operation involves passing a needle and thread repeatedly through the plane of the fabric.

A typical structure used to hold needleworking fabric is shown in U.S. Pat. No. 4,590,965 (McGillivray, 1986) which discloses an adjustable quilting frame with a base having an articulated jointed arm pivotally attached and a cradle attached to the far end of the articulated arm for manipulating the hoop. All of the joints include releasable locking nuts so as to position or orient the hoop at a number of desired angles at a variety of distances from the base of the device.

Another structure for supporting fabric for needlework activities is disclosed in U.S. Pat. No. 1,357,737 (Solaini). Solaini discloses an embroidery frame which includes a jig consisting of inner and outer concentric hoops, the outer hoop being split and having a tightening screw extending between its ends so that it can be tightened about the periphery of the inner hoop. The fabric is stretched across the inner hoop and held in position by clamping the arrangement of the outer hoop against the inner hoop. The hoops are mounted to a floor stand by an upright post and a pivot connection, so that the hoops can be tilted relative to the horizontal.

Another device for supporting fabric for needlework activity is disclosed in U.S. Pat. No. 3,855,718 (Parsons). The Parsons frame work differs from the Solaini frame work in that the bracket supporting the concentric hoops is attached to a floor stand by a ball-and-socket connection, which permits the hoop to be tilted from the horizontal in any direction.

The frames disclosed, however, do not provide for an adjustable frame that holds the concentric hoops horizontally away from the frame support legs such that a chair of the quilter and the quilter's feet may be free from entanglement with the frame support legs. That is, the device of the present invention provides for an adjustable hoop support frame mounted on a vertical support column so as to rotatably pivot, and a horizontal plane perpendicular to the vertical support column. Such an adjustable frame provides an area beneath and above the quilting hoop that is substantially free from obstructions.

In addition, the aforementioned inventions fail to provide for a device where the jointed arm on which the hoop is retained may be lengthened or shortened, such that a shorter lever arm is acting at the joint of the arm. That is, the device of the present invention provides the length of the jointed arm may be adjustably preset at the joint between the two arm members of the jointed arm.

Finally, the device of the present invention provides for a device which is foldable into a compact size for ease of transportation. That is, the device of the present invention provides for the main members thereof to be easily and compactly folded together.

These and other objects of this invention are provided by a horizontal basemounted device for adjustably locating a quilting hoop, the device comprising a vertical support column, said vertical support column having a first end and a second end, the second end thereof having means to anchor said vertical support column to the horizontal base such that said vertical support column projects substantially vertically from the horizontal base; a jointed arm, said jointed arm comprising a first arm member and a second arm member, the two arm members each having a free end and a fixed end, the fixed end of the first arm member being rotatably mounted to said vertical support column so as to rotate about the axis of said vertical support column in a plane perpendicular thereto, the free end of the first arm member rotatably attached to the fixed end of the second arm member such that the second arm member also rotates in a plane perpendicular to said vertical support column; a rotatable bar adjustably mounted to the free end of the second arm member, said rotatable bar having a longitudinal axis at a fixed distance from and parallel to the second arm member; a quilting hoop support beam having means to mount quilting hoops of different sizes; an axle for rotatably mounting said quilting hoop support beam at a center thereof, to said rotatable bar; and means to releasably attach the quilting hoops to said quilting hoop support beam.

DETAILED DESCRIPTION OF THE PREFERRED EMBODIMENT

Figure 1:
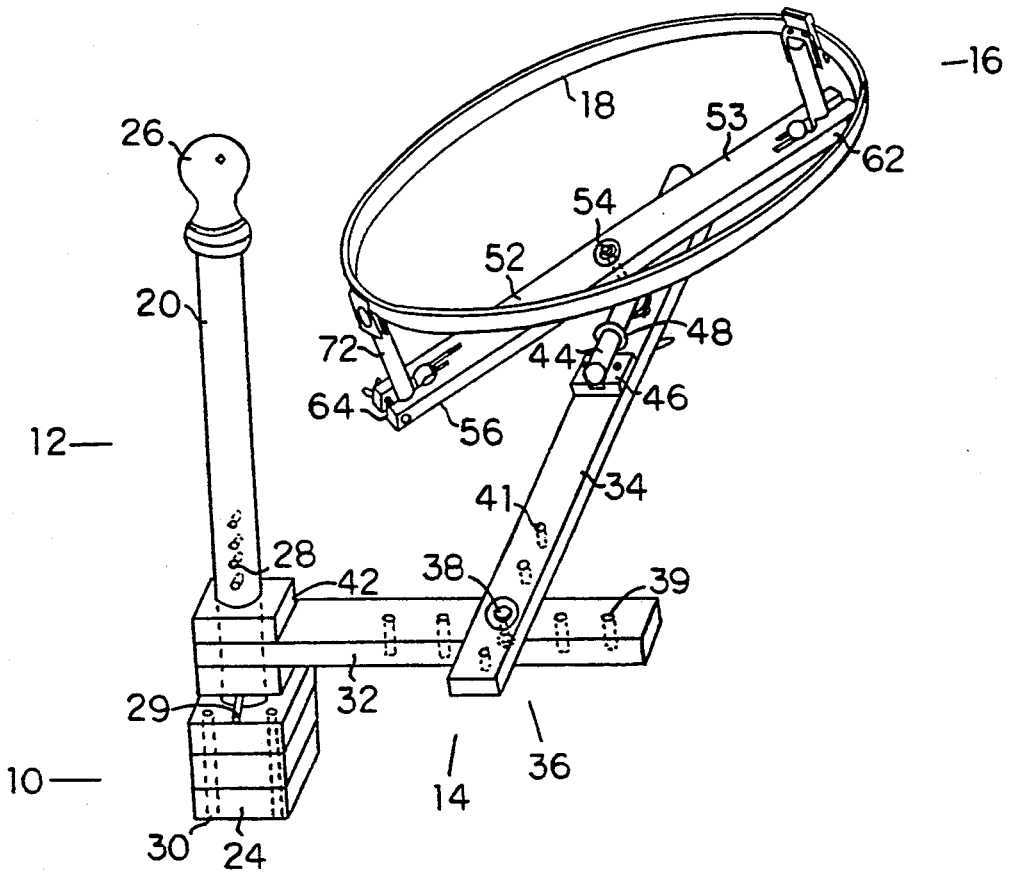
FIG. 1 is a perspective view of the device of the present invention.
Figure 3:
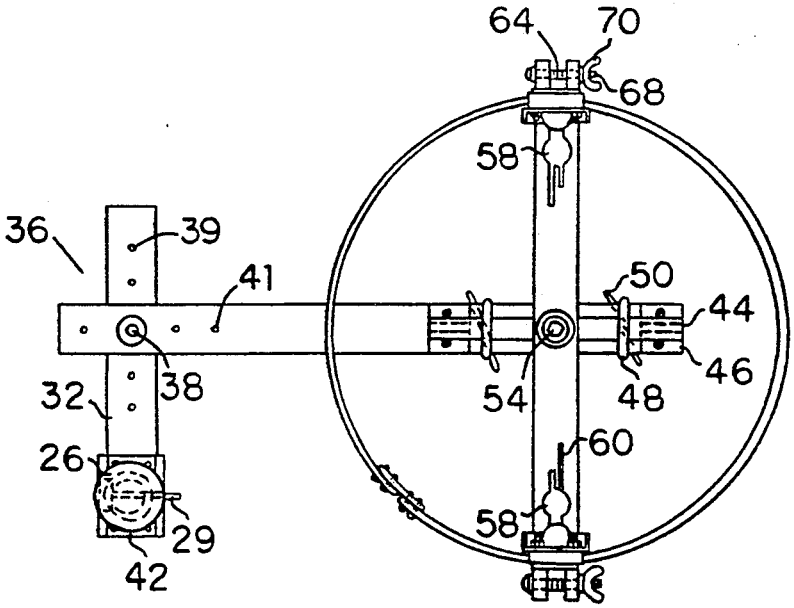
FIG. 3 is a top view of the device of the present invention with the hoop support beam rotated 90° from its orientation as illustrated in FIG. 2.
Figure 2:
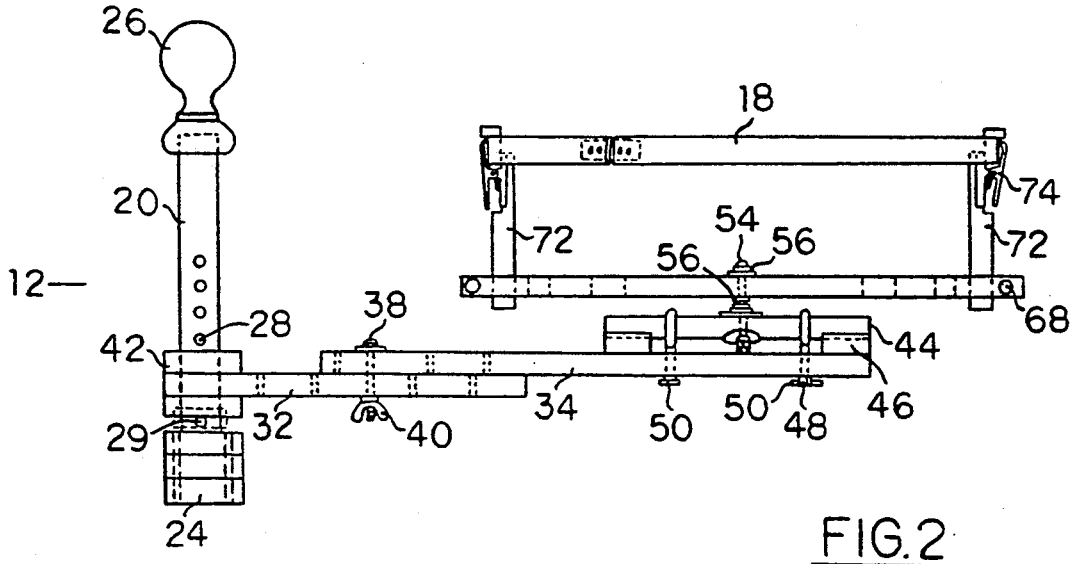
FIG. 2 is a side view of the device of the present invention with the hoop support beam rotated so it is aligned in the horizontal plane, perpendicular to the view.

FIGS. 1, 2, and 3 illustrate various views of adjustable quilting hoop stand (10) of the present invention. As can be seen in FIGS. 1, 2, and 3, adjustable quilting hoop stand (10) is comprised of a vertical column (12) adjoined to a jointed arm (14) and a rotatable brace (16) supporting a quilting hoop (18). Vertical column (12) is cylindrical and elongated. It is usually made of wood and has a body (20) with a support block (24) at one end thereof and an ornamental knob (26) at the other end thereof. As can be seen in FIGS. 1 and 2, support block (24) is generally rectangular, made of wood, and has several bolt holes (30) therethrough for anchoring vertical column (12) to a horizontal base such as a table or stand. Support block (24) may be comprised of three small and similarly-dimensioned blocks that are rigidly glued and clamped together. In this fashion, support block (24) provides a means of attaching vertical column (12) to a horizontal surface. Ornamental knob (26) serves a dual purpose of providing an aesthetically pleasing look and also a means for preventing jointed arm (14) from sliding up and off the vertical column (12).

Body (20) of vertical column (12) has several adjustment holes (28) drilled therethrough, as well as a dowel pin (29) matching generally the dimensions of adjustment holes (28). The system of adjustment holes (28) and similarly dimensioned dowel pin (29) provides an effective means for positioning jointed arm (14) vertically at a preselected distance above support block (24).

Turning now to the details of jointed arm (14), it can be seen in FIGS. 1, 2, and 3 that jointed arm (14) is comprised of a first arm member (32) rotatably attached to a second arm member (34) at an elbow (36). A bolt (38) is dimensioned to be received within several adjustment holes (39) (41) at the removed end of first arm member (32) and the fixed end of second arm member (34). That is, first arm member (32) has a fixed end rotatably attached to vertical support column (12) and a removed or free end having adjustment holes (39). Second arm member (34) has adjustment holes (41) at the fixed end thereof, and rotatable brace (16) mounted at the removed or free end thereof. Bolt (38) is secured in adjustment holes (39) (41) by wing nut (40), which allows for easy removal or tightening of jointed arm (14).

Jointed arm (14) therefore provides a means for rotatable brace (16) with quilting loop (18) attached to be positioned horizontally away from vertical column (12) and the support stand or table on which it rests. In other words, rotatable brace (16) can swing out from vertical column (12) and allow the quilter's legs or a chair to fit underneath the quilting hoop, without having structure above the hoop. In addition, it can be seen that jointed arm (14) allows for maintaining the position of quilting hoop (18) from vertical column (12) while providing for the lengthening or shortening of jointed arm (14).

Turning now to the removed or free end of second arm member (34), it can be seen that the rotatable base is comprised of rotatable bar (44) held to the removed end of second arm member (34) on stand-offs (46) and secured by eye bolts (48). Eye bolts (48) are provided with wing nuts (50) for allowing compression between rotatable bar (44) and stand-offs (46), such compression both locating rotatable bar (44) securely along an axis parallel to second arm member (34) and also horizontally (with respect to the vertical support column). As can be further seen in FIGS. 1, 2, and 3, the loosening of adjuster nut (50) allows the quilter to rotate the plane of quilting hoop (18) about an axis parallel with second arm member (34), at least until support beam (52) strikes removed or free end of second arm member (34).

Mounted on rotatable bar (44) is quilting hoop support beam (52). At the center (53) of quilting hoop support beam (52) is axle (54) having bearings (56) and extending through the center of rotatable bar (44) so as to allow quilting hoop (18) to rotate about an axis represented by axle (54). Thus, the quilter can rotate her (or his) work while quilting to get at the various areas of the fabric.

Quilting hoop support beam (52) has at the outer ends thereof means for supporting quilting hoop (18), the means comprising bores (58) (62) and slots (60) (64). As can be seen in FIG. 3, quilting hoop support beam (52) can be seen to have inner bores (58) and outer bores (62) thereon. Inner bores (58) are slotted with inner slots (60). Tightening bolt (68) and wing nut (70) are used to tighten down on hoop legs (72) which are dimensioned to be received within bores (58) and (62). By having two paired sets of bores (58) and (62), the device of the present invention is easily adapted to use to common sizes of quilting hoops—16 inches and 18 inches in diameter. Of course, additional sets of bores and tightening bolts may be added to accommodate still different sizes of hoops.

Specifically, hoop legs (72) can be seen to have hoop clips (74) on a removed end thereof. Hoop clips (74) provide a means to releasably engage, through a spring enclosed within clips (74), quilting hoop (18). In this way, depressing clips (74) will easily remove hoops (18) allowing the user to move the fabric around. If the user desires using a smaller diameter hoop than that illustrated in the accompanying figures, they simply substitute the smaller diameter hoop and move hoop legs (72) into inner bores (58), tighten nut (70) of tightening bolt (68), thus preventing the removal of quilting hoop (18) from quilting hoop support beam (52).

In use, the quilter, assumed to be sitting in a chair (not shown) with adjustable quilting hoop stand (10) affixed to a stand or table adjacent to the chair, will adjust jointed arm (14) vertically until it is located about 6 to 12 inches above the quilter's knees. The horizontal distance from the user is controlled by changing the included angle between first arm member (23) and second arm member (34) and/or lengthening jointed arm (14) by removing bolt (38) and repositioning adjustment holes (39) and (41) of first arm. The quilter then adjusts the proper angle of quilting hoop (18) with respect to the horizontal, adjuster nuts (50) of eye bolt (48) are loosened, allowing quilting hoop to tilt.

Thus it can be seen that the quilting hoop of the present invention provides for a device that is adjustable vertically and horizontally while allowing for freedom from obstruction above and below the hoop.

Terms such as "left", "right", "up", "down", "bottom", "top", "front", "back", "in", "out" and the like are applicable to the embodiment shown and described in conjunction with the drawings. These terms are merely for the purposes of description and do not necessarily apply to the position or manner in which the invention may be constructed or used.

Although the invention has been described with reference to a specific embodiment, this description is not meant to be construed in a limiting sense. On the contrary, this description is not meant to be construed in a limiting sense. On the contrary, various modifications of the disclosed embodiments will become apparent to those skilled in the art upon reference to the description of the invention. It is therefore contemplated that the appended claims will cover such modifications, alternatives, and equivalents that fall within the true spirit and scope of the invention.

I claim:

1. A horizontal base-mounted device for adjustably locating a quilting hoop, the device comprising:

a vertical support column, said vertical support column having a first end and a second end, the second end thereof having means to anchor said vertical support column to the horizontal base such that said vertical support column projects substantially vertically from the horizontal base;

a jointed arm, said jointed arm comprising a first arm member and a second arm member, the two arm members each having a free end and a fixed end, the fixed end of the first arm member being rotatably mounted to said vertical support column so as to rotate about the axis of said vertical support column in a plane perpendicular thereto, the free end of the first arm member rotatably attached to the fixed end of the second arm member such that the second arm member also rotates in a plane perpendicular to said vertical support column;

means to selectively adjust the position of said jointed arm along said vertical support columns;

a rotatable bar adjustably mounted to the free end of the second arm member, said rotatable bar having a longitudinal axis at a fixed distance from and parallel to the second arm member;

a quilting hoop support beam having means to releasably mount quilting hoops of different sizes to said quilting hoop support beam; and an axle for rotatably mounting said quilting hoop support beam, at a center thereof, to said rotatable bar.

2. The device of claim 1 further comprising means to selectively adjust the length of said jointed arm.

3. The device of claim 1 further comprising an ornamental knob, said ornamental knob attached to the first end of said vertical support column, and sized to prevent said jointed arm from sliding off said vertical support column.

4. The device of claim 1 further comprising two hoop support legs for mounting on a first end thereof to mounting means of said quilting hoop support beam.

5. The device of claim 4 wherein the second ends of said two hoop support legs include means for releasably grasping the quilting hoop.

6. The device of claim 5 wherein said grasping means comprises two spring-loaded clips, one each attached to the second end of each of said two hoop support legs.

7. The device of claim 5 wherein the mounting means of said quilting hoop support beam comprises a plurality of spaced-apart holes in the ends of said quilting hoop support beam, the holes for engageably receiving the first end of the hoop support legs.

8. The device of claim 7 further comprising means for releasably compressing said rotatable bar against the free end of the second arm member of said jointed arm.

9. The device of claim 8 wherein said compressing means comprises a pair of eye bolts and a pair of stand-offs, the eyes of the eye bolts for encircling the ends of said rotatable bar and the legs of the eye bolts for joining the eye bolts to the free end of the second arm member of said jointed arm, and the stand-offs to space said rotatable bar off the second arm member.

10. The device of claim 9 wherein said length adjustment means further comprises a plurality of bolt holes in the free end of the first arm member of said jointed arm, and the fixed end of the second arm member of said jointed arm, and a bolt, dimensioned to and capable of being received into two of the plurality of bolt holes of the arm members of said jointed arm when the bolt holes are vertically aligned.

11. The device of claim 3 wherein the fixed end of the first arm member of said jointed arm includes an arm block for strengthening the mounting of said jointed arm to said vertical support column.

12. A horizontal base-mounted device for adjustably locating a quilting hoop, the device comprising:

a vertical support column having a support block at a second end thereof, the support block having bolt holes therethrough for attaching said vertical support column to the horizontal base, said vertical support column having a series of adjustment holes therethrough, said adjustment holes along the vertical axis thereof;

a jointed arm with a first end and a second end, the first end having a hole for receipt onto said vertical support column such that said jointed arm can rotate about said vertical support column in a plane perpendicular to the axis of said vertical support column, said jointed arm further comprising a means for selectively adjusting the length thereof;

a pin dimensioned to snugly engage the adjustment holes of said vertical support column and to provide engagement with said jointed arm to locate said jointed arm at a preselected distance;

a rotatable bar mounted parallel to and at the removed end of said jointed arm;

a quilting hoop support beam mounted to the center of said rotatable bar, said quilting hoop support beam having means integral therewith for removably accepting a quilting hoop of a preselected variety of diameters.

13. The device of claim 12 further comprising an ornamental knob, said ornamental knob attached to the first end of said vertical support column, and sized to prevent said jointed arm from sliding off said vertical support column.

14. The device of claim 13 further comprising two hoop support legs, each of said hoop support legs for attaching at a first end to said quilting hoop support beam and having at the second end thereof means to graspably receive the quilting hoop.

15. The device of claim 14 wherein the accepting means of said quilting hoop support beam comprises a plurality of paired, spaced-apart holes at opposite ends of said quilting hoop support beam for receipt of the first ends of said two hoop support legs and further comprising means to compress the diameter of the holes so the wall thereof contract against said hoop support legs.

16. The device of claim 15 wherein the grasping means of said two hoop support legs comprise a spring-biased clip at the second end of each of said two hoop support legs.

17. The device of claim 16 further comprising means for releasably compressing said rotatable bar against the free end of the second arm member of said jointed arm.

18. The device of claim 17 wherein said compressing means comprises a pair of eye bolts and a pair of stand-offs, the eyes of the eye bolts for encircling the ends of said rotatable bar and the legs of the eye bolts for joining the eye bolts to the free end of the second arm member of said jointed arm, and the stand-offs to space said rotatable bar off the second arm member.

* * * * *